US010464340B1

(12) United States Patent
Dal

(10) Patent No.: US 10,464,340 B1
(45) Date of Patent: Nov. 5, 2019

(54) HIGH SECURITY PRINTER USING COLOR-CODE COMBINATION INKS AND METHOD THEREOF

(71) Applicant: Yilmaz Dal, Istanbul (TR)

(72) Inventor: Yilmaz Dal, Istanbul (TR)

(73) Assignee: Yilmaz Dal, Istanbul (TR)

( * ) Notice: Subject to any disclaimer, the term of this patent is extended or adjusted under 35 U.S.C. 154(b) by 0 days.

(21) Appl. No.: 16/104,068

(22) Filed: Aug. 16, 2018

(51) Int. Cl.

| | |
|---|---|
| ***B41M 3/14*** | (2006.01) |
| ***B41J 2/21*** | (2006.01) |
| ***B41J 29/393*** | (2006.01) |
| *B41F 31/02* | (2006.01) |
| *B41F 31/00* | (2006.01) |

(52) U.S. Cl.
CPC ..... *B41J 2/2103* (2013.01); *B41J 29/393* (2013.01); *B41M 3/14* (2013.01); *B41F 31/002* (2013.01); *B41F 31/022* (2013.01)

(58) Field of Classification Search
CPC ..... B41J 2/2103; B41J 29/393; B41M 3/14; B41F 31/002; B41F 31/022
See application file for complete search history.

(56) References Cited

FOREIGN PATENT DOCUMENTS

| | | | | |
|---|---|---|---|---|
| CN | 106096971 A | * | 11/2016 | ..... G06K 9/00 |
| CN | 106096971 A | | 11/2016 | |
| CN | 106427235 A | | 2/2017 | |
| WO | WO 2004/089640 A3 | | 10/2004 | |
| WO | WO-2004089640 A2 | * | 10/2004 | ..... B41M 3/008 |

* cited by examiner

*Primary Examiner* — Yaovi M Ameh
(74) *Attorney, Agent, or Firm* — Gokalp Bayramoglu

(57) ABSTRACT

The present invention relates to a printer which enables high security printing using color-code combination inks on company/brand/product/control gate working areas on the special printing material surface and method of operating the printer. Each special printing material printed with high security is used on a different original product that is exposed for sale. The spectrometer sensor embedded in the smartphone scans and analyzes the working area on the special printing material surface to be printed with high security and matches exactly the spectrum characteristic peak value with the peak value on the cloud system and displays the name of the scanned working area and the spectrum characteristic peak value on the screen of the smartphone. The present invention relates to a printer that allows the end user to buy an original product printed with high security using color-code combination inks on a special printing material surface.

20 Claims, 8 Drawing Sheets

HIGH SECURITY PRINTER USING COLOR-CODE COMBINATION INKS AND METHOD THEREOF

BACKGROUND OF THE INVENTION

1. Field of Invention

The present invention is a printer which enables high security printing using color-code combination inks on company/brand/product/control gate working areas on a special printing material surface and method thereof. Each special printing material printed with high security is used on a different original product that is exposed for sale. The spectrometer sensor embedded in the smartphone scans and analyzes the working area on the special printing material surface to be printed with high security and matches exactly the spectrum characteristic peak value with the peak value on the cloud system and displays the name of the scanned working area and the spectrum characteristic peak value on the screen of the smartphone. The present invention relates to a printer that allows the end user to buy an original product printed with high security using color-code combination inks on a special printing material surface.

2. Background Art

The state of the art presents with developments that enable the user to understand whether the product to be bought is original or not. However, these developments do not ensure the detection of original products since they do not include practical control methods or they are imitable.

As an example of the state of the art, patent no. CN106096971 discloses that a measure has been taken against forgery through the use of a randomly generated image in the shape of a sawtooth located next to the product's barcode. It is not mentioned whether the method of the said invention includes high security working areas for original product detection and whether color-code combination inks are used.

Another example of the state of the art is the patent no. CN106427235, which discloses a printer marking the lottery tickets through a secret code generated via an encrypting chip for lottery tickets. It can be understood that the said invention is a method developed solely for lottery tickets.

Another example of the state of the art is patent no WO2004089640, which discloses a printing method using inks of fluorescent colors and invisibly marking for authentication, decoration and information. In the said invention, a system which can be used as a practical control method by the user is not mentioned.

Therefore, there is a need for development of a printer with high security using color-code combination inks on working areas on special printing material surfaces which is highly difficult to be imitated compared to other methods.

SUMMARY

A color system of color-code combination inks is generated in various combinations. The special printing material type that is manufactured as well as the additive get coded together. The special printing material type to be used for the printing, the number and order of the high security working areas on the surface of the special printing material to be printed, the number of different inks to be used for each working area, the micron value of the printing thickness to be implemented and dimensions of each working area are obtained via a computer program, transferred to the printer in a file format to be printed and stored in the memory.

With the help of a predefined algorithm, the microprocessor selects three different color-code combination inks for company/brand/product gate working areas that will be included on the special printing material surface to be printed as well as two different color-code combination inks for the control gate working area that will be included on the same special printing material surface and places them in the color unit accordingly. Each one of the five different color-code combination inks placed in the color unit is put in the ink tank.

Following the calculation and notification of the value of the ink volume to be consumed via a predefined algorithm on the digital screen of the ink tank in which each one of the three different color-code combination inks to be used in the company/brand/product gate working areas included on the special printing material surface is put, the ink is consumed and submitted to the print head via the ink transmitter.

Following the calculation and notification of the changing value of the ink volume to be consumed for the homogeneous ink mixture via a predefined algorithm on the digital screen of the ink tank in which each one of the two different color-code combination inks to be used in the control gate working area included on the same special printing material surface is put, the ink is consumed and first mixed in the ink transmitter. Thereafter, the homogeneous ink mixture obtained by the short-term vibrations of the ink transmitter is sent to the print head.

The electronic material sensor identifies the type of the special printing material to be used for printing as well as the additives and transmits the code to the microprocessor. The ink heater in the print head heats the inks received by the print head to a particular temperature according to the electrical signals from the control unit. The heated inks are sprayed from the active pores in the print head to the working areas on the surface of the special printing material with the specified micron value under a certain pressure for printing.

Additional features and benefits of the present invention will become apparent from the detailed description, figures and claims set forth below.

BRIEF DESCRIPTION OF THE DRAWINGS

The exemplary embodiments of the present invention will be understood more fully from the detailed description given below and from the accompanying drawings of various embodiments of the invention, which, however, should not be taken to limit the invention to the specific embodiments, but are for explanation and understanding only.

Figure 1:
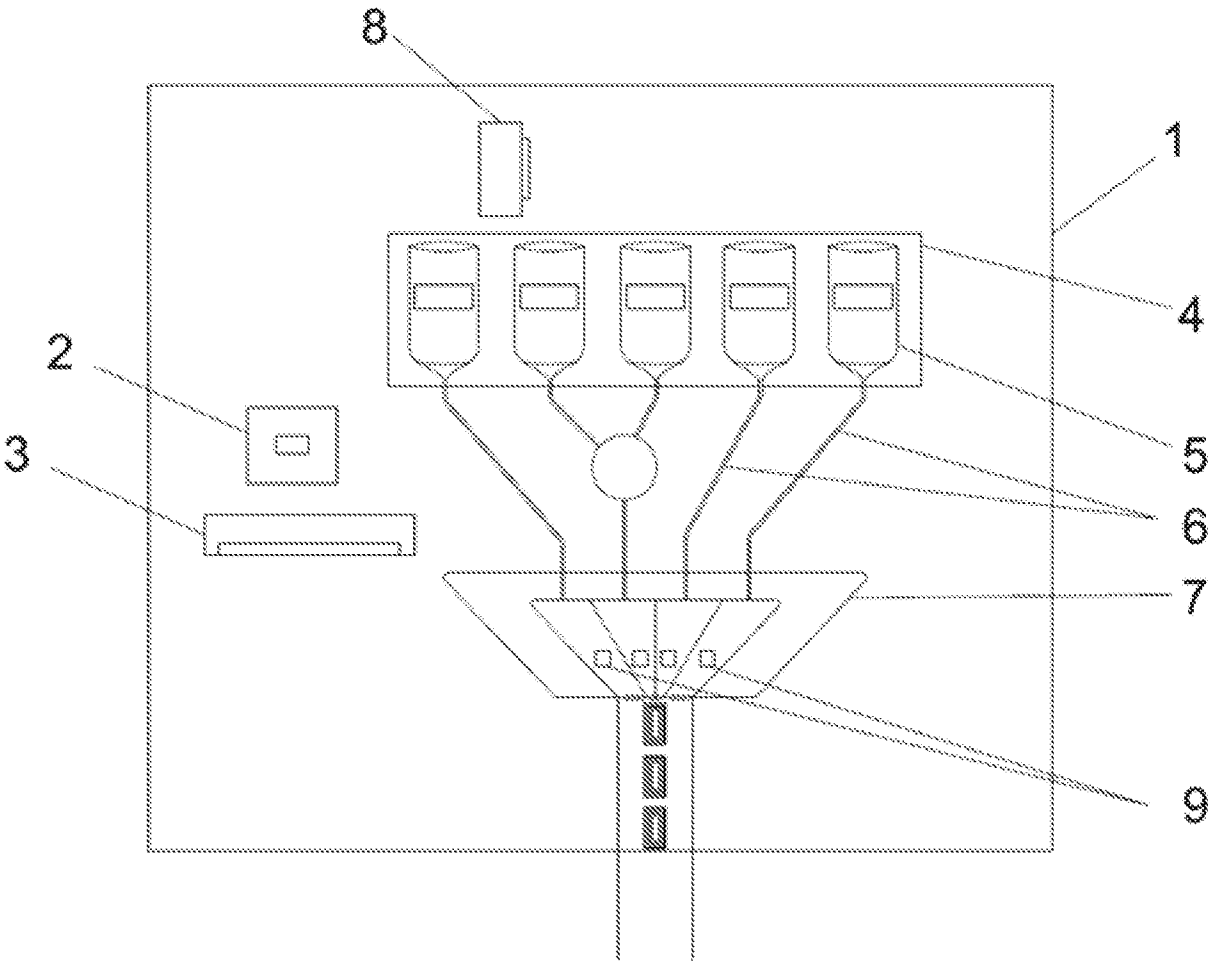
FIG. 1 is a representation of the high security printer using color-code combination inks, in accordance with the present invention.

Figures are merely representative and illustrative of the invention. In the following description, solely the elements that are illustrative of the invention are emphasized while the elements unnecessary for the clarification of the invention are omitted.

DESCRIPTION OF THE REFERENCES OF THE ELEMENTS

1 Printer
2 Microprocessor
3 Memory
4 Color unit
5 Ink tank
6 Ink transmitter
7 Print head
8 Electronic material sensor
9 Ink heater
10 Customized handheld spectrometer sensor
11 Spectrometer sensor embedded in the smartphone

DETAILED DESCRIPTION OF THE INVENTION

Those of ordinary skilled in the art will realize that the following detailed description is illustrative only and is not intended to be in any way limiting. Other embodiments of the present invention will readily suggest themselves to skilled persons having the benefit of this disclosure. Reference will now be made in detail to implementations of the exemplary embodiments of the present invention as illustrated in the accompanying drawings. The same reference indicators or numbers will be used throughout the drawings and the following detailed description to refer to the same or like parts.

In the ink laboratory, required amounts of the two or more-colored inks are taken and mixed homogeneously to obtain various color-code combination inks. Required amounts of the color-code combination inks produced in different combinations are taken and various color-code combination inks are obtained by mixing homogeneously. The steps for producing color-code combination inks are repeated with different combinations and thus thousands of unique color-code combination inks are obtained for the generation of a color system.

According to the usage areas of the color-code combination inks, the special printing materials are manufactured from various materials, in standard dimensions and in two layers. In the manufacturing stage of the special printing material, different additives are added according to the material types. The special printing material type that is manufactured as well as the additive get coded together.

The special printing material type to be used for the printing, the number and order of the high security working areas on the surface of the special printing material to be printed, the number of different inks to be used for each working area, the micron value of the printing thickness to be implemented and dimensions of each working area are obtained via a computer program and transferred to the printer (1) in a file format to be printed and stored in the memory (3). FIG. 1 is a representation of a high security printer (1) using color-code combination inks, in accordance with the present invention.

With the help of a predefined algorithm, the microprocessor (2) selects three different color-code combination inks for company/brand/product gate working areas that will be included on the special printing material surface to be printed as well as the two different color-code combination inks for the control gate working area that will be included on the same special printing material surface.

The three different color-code combination inks selected for the company/brand/product gate working areas that will be included on the special printing material surface as well as the two different color-code combination inks to be used for the control gate working area that will be included on the same special printing material surface are placed on the color unit (4) with the help of a predefined algorithm. Each one of the five different color-code combination inks placed in the color unit (4) is put in the ink tank (5).

The value of the ink volume to be consumed is determined via a predefined algorithm on the digital screen of the ink tank (5) in which each one of the three different color-code combination inks to be used in the company/brand/product gate working areas included on the special printing material surface is put.

While the value of the ink volume to be consumed for the homogeneous ink mixture of each of the two different color-code combination inks for the control gate working area that will be included on the same special printing material surface decreases, the value of the ink volume of the other ink to be consumed for the ink mixture increases accordingly. In this way, the ratios of the two different color-code combination inks to be used for the control gate working area that will be included on the same special printing material surface in the homogeneous ink mixture continuously change for each of the special printing material surface.

The changing value of the ink volume to be consumed for the homogeneous ink mixture on the digital screen of the ink tank (5) in which each one of the two different color-code combination inks to be used on the control gate working area included on the same special printing material surface is put, is calculated via a predefined algorithm.

The value of the ink volume to be consumed is displayed on the digital screen of the ink tank (5) in which each one of the three different color-code combination inks to be used in the company/brand/product gate working areas included on the special printing material surface is put and the ink is consumed and sent to the print head (7) via the ink transmitter (6).

After the changing value of the ink volume to be consumed for the homogeneous ink mixture is displayed on the digital screen of the ink tank (5) in which each one of the two different color-code combination inks to be used in the control gate working area included on the same special printing material surface is put, the ink is consumed and first mixed in the ink transmitter (6). Thereafter, the homogeneous ink mixture obtained by the short-term vibrations of the ink transmitter (6) is sent to the print head (7).

The electronic material sensor (8) placed in the material feeding area identifies the type of the special printing material to be used for printing as well as the additives and transmits the code to the microprocessor (2). The microprocessor (2) notifies the user that the printer (1) is ready for the printing process following the approval of the code of the additive and the special printing material type to be used for printing.

Special printing materials with roll feed are sent to the area to be printed via the rolling cylinder. According to the size of the working areas on the special material surface to be printed, a part of the pores on the print head (7) are opened and become active while the other pores that will not operate become passive. The ink heater (9) in the print head (7) heats the inks received by the print head (7) to a particular temperature according to the electrical signals from the control unit. With the help of the engine that triggers the print head (7) without contacting the printing material, the heated inks are sprayed with a pressure from the active pores in the print head (7) directly to the working areas on the special printing material surface for the printing of the specified micron value.

Figure 2:
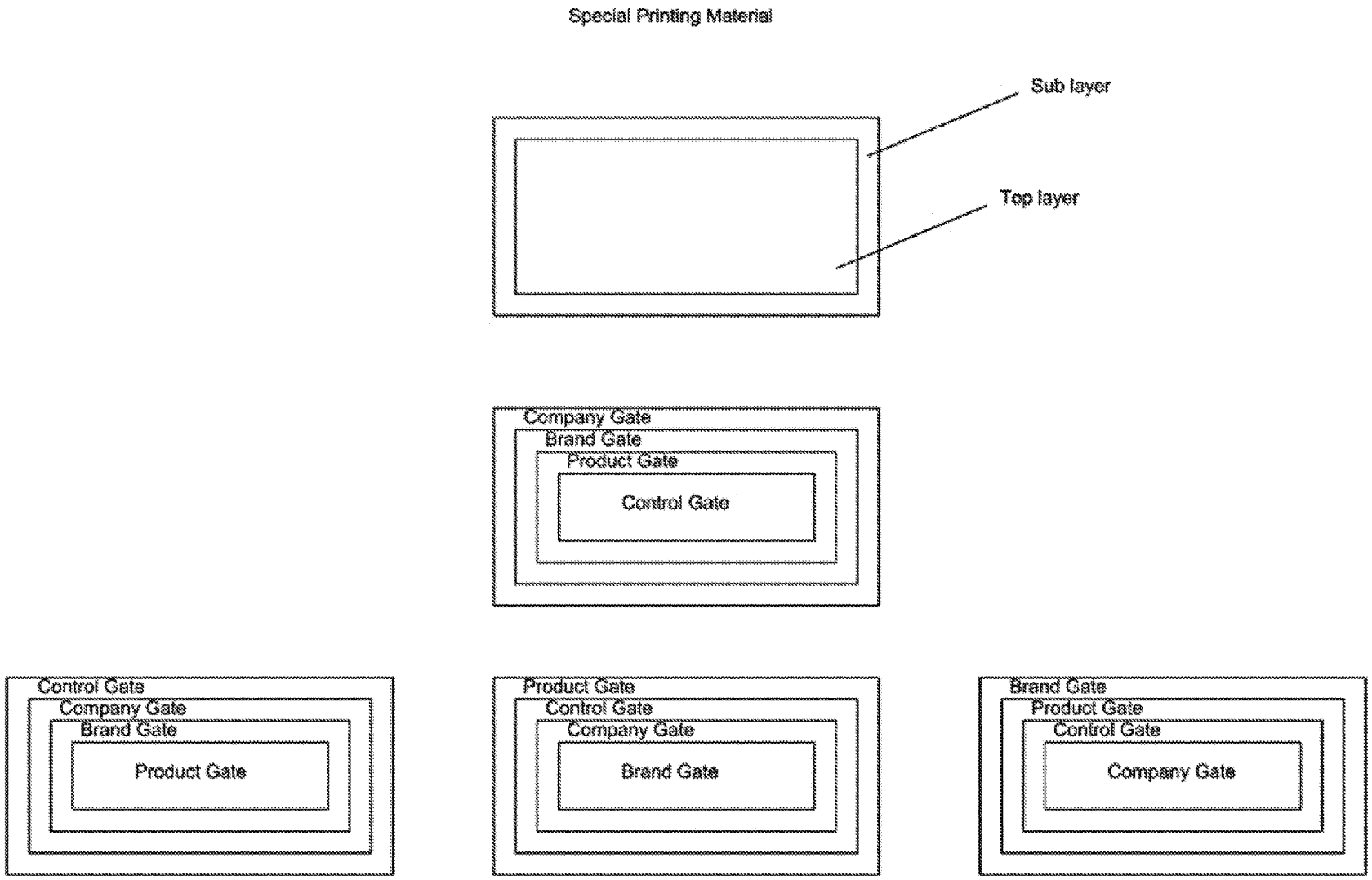
FIG. 2 is a representation of the special printing material and the order of the company/brand/product/control gate working areas on the special printing material surface to be printed, in accordance with the present invention.

The printer (1) enables high security printing using color-code combination inks on company/brand/product/control gate working areas on the special printing material surface. See FIG. 2. The spectrum characteristic peak values of the company/brand/product gate working areas on the special printing material to be printed are different from each other. However, these working areas to be included on each special printing material surface that is printed always give the same characteristic peak values.

Figure 3:
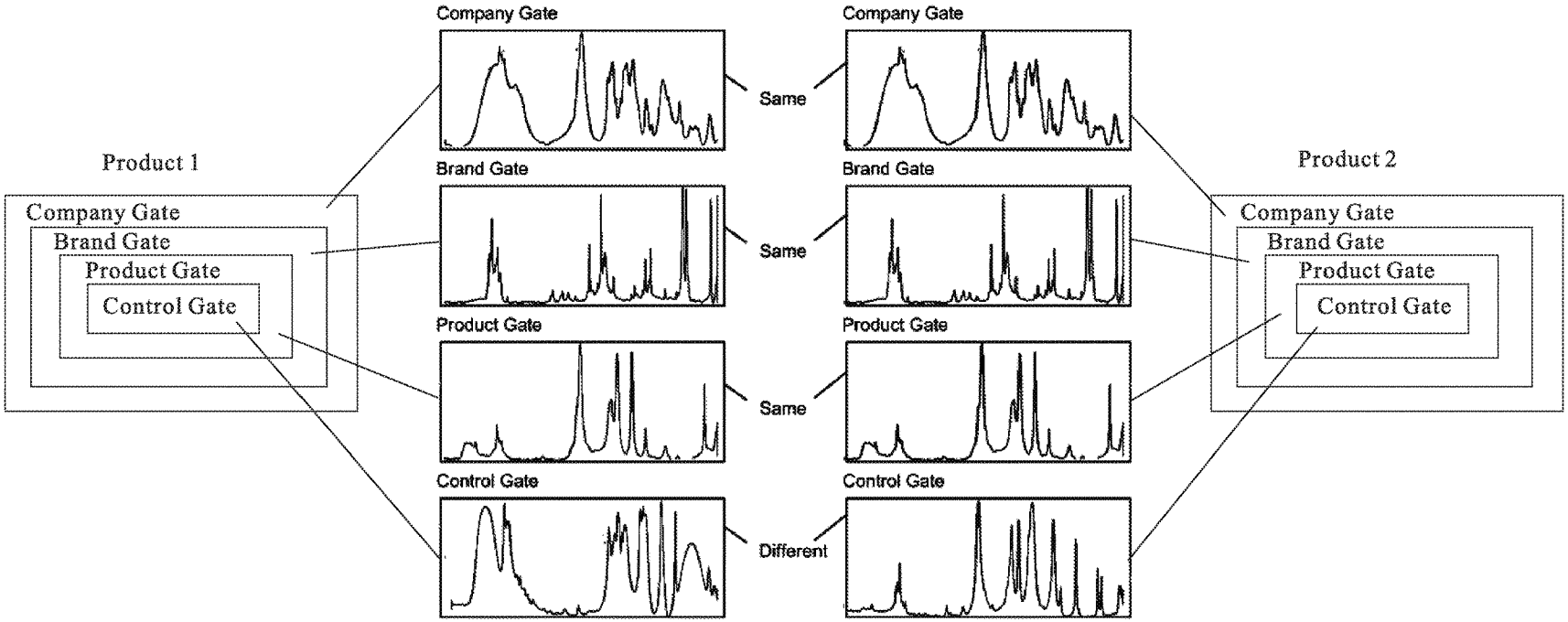
FIG. 3 is a representation showing that the spectrum characteristic peak value of the control gate working area on the special printing material to be printed is always different for each product, in accordance with the present invention.

As shown in FIG. 3, the spectrum characteristic peak value of the control gate working area on the same special printing material surface that is printed is always different on each special printing material surface. This is because the ratios of the inks of the homogenous ink mixtures used on the control gate working area continuously change for each special printing material surface.

As shown in FIG. 3, the spectrum characteristic peak values of the working areas on each special printing material surface that is printed with high security are coded with a predefined algorithm, archived in the main server, backed up and stored. The spectrum characteristic peak values of the working areas on each special printing material surface that is printed with high security are loaded on the cloud system. Each special printing material printed with high security is used on a different original product that is exposed for sale.

Figure 4:
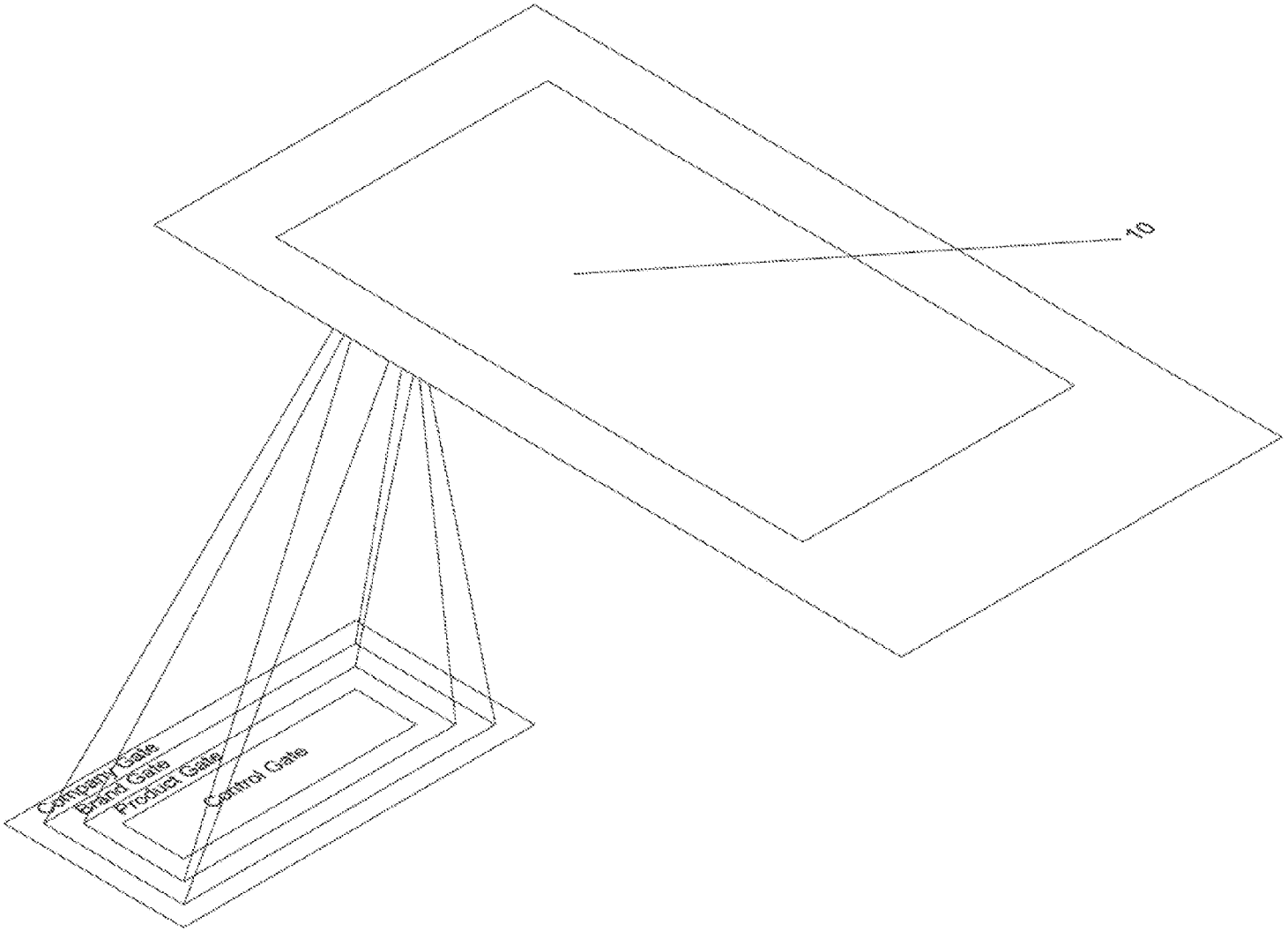
FIG. 4 is a representation of the working area scanning on the special printing material surface printed with high security of the customized handheld spectrometer sensor, in accordance with the present invention.
Figure 5:
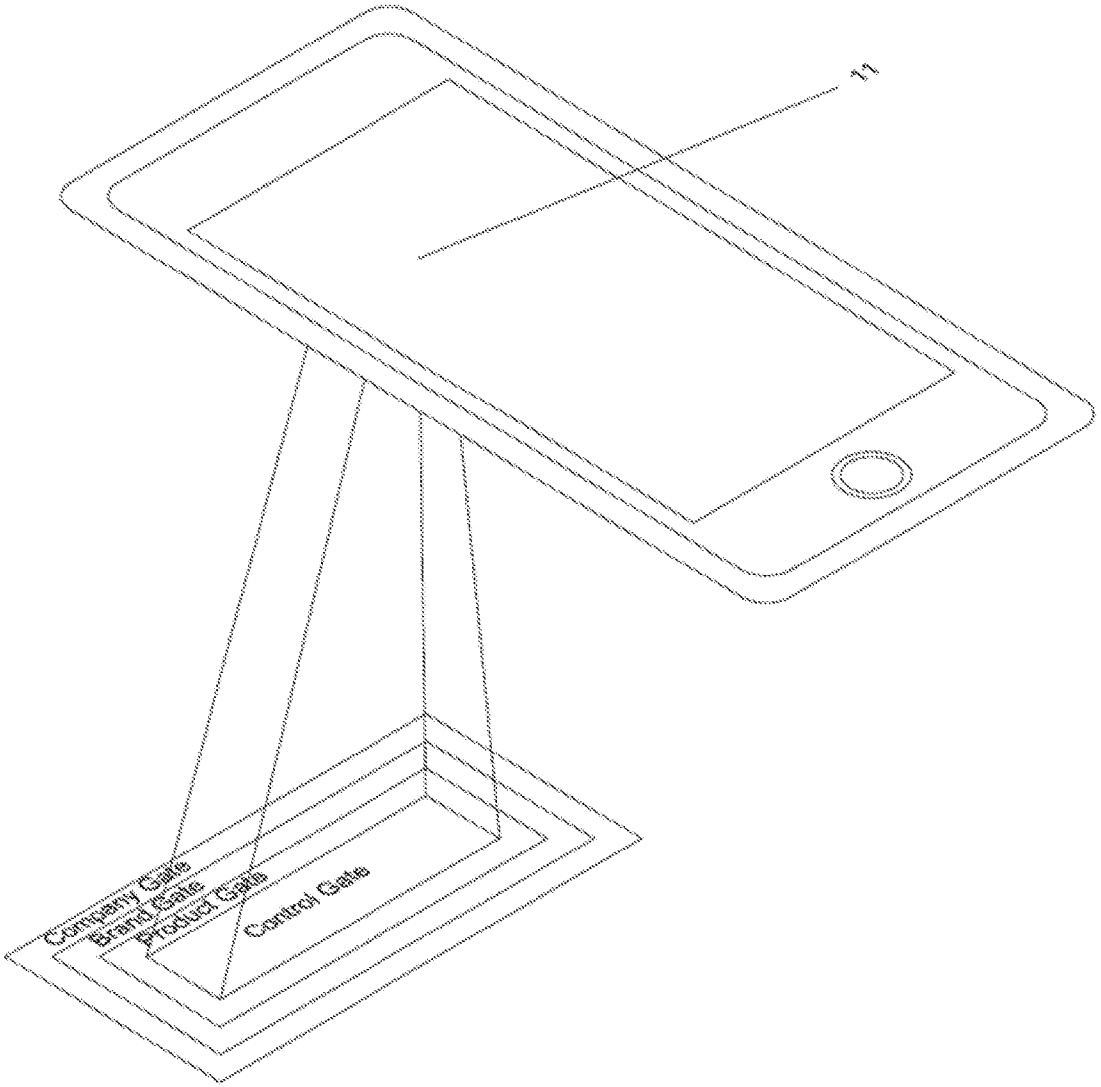
FIG. 5 is a representation of the working area scanning on the special printing material surface printed with high security of the spectrometer sensor embedded in the smartphone, in accordance with the present invention.

There are two control methods for the high security printing implemented by the printer (1) on the working areas of the special printing material surface using color-code combination inks. One is a control method for the customized handheld spectrometer sensor (10) intended for industrial use for product control and registering in the original product manufacturing sites and sales points. (See FIG. 4). The other control method is the spectrometer sensor (11) embedded in the smartphone by which the end user can check whether the product to be purchased is original or not. (See FIG. 5).

Figure 6A:
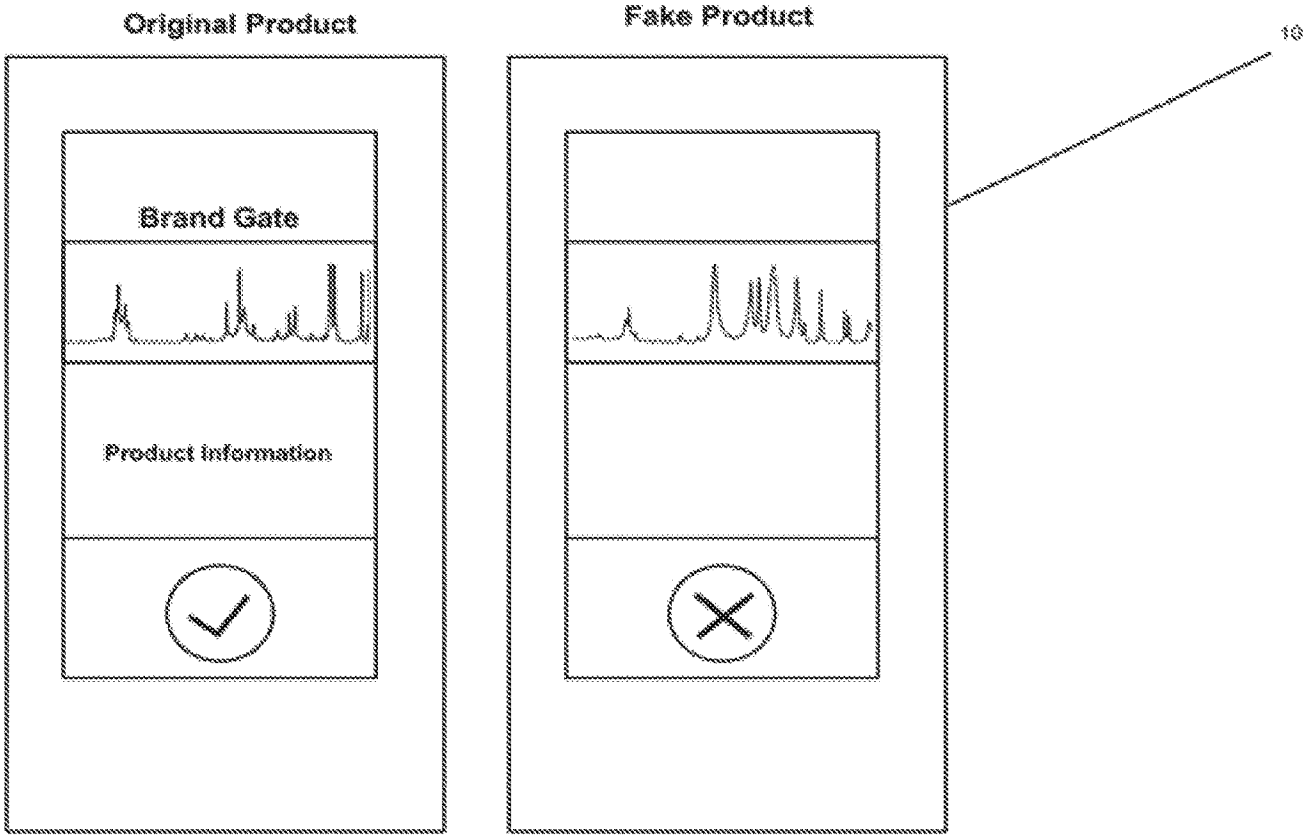
FIGS. 6A-6B are representations showing the customized handheld spectrometer sensor and the original product detection of the spectrometer sensor embedded in the smartphone, in accordance with the present invention.

The customized handheld spectrometer sensor (10) scans and analyzes the working areas on the special printing material surface that is printed with high security, then displays the name of the scanned working area and the spectrum characteristic peak values of each working area on the screen. The customized handheld spectrometer sensor (10) scans and analyzes the working area on the special printing material surface that is printed with high security, then matches exactly the spectrum characteristic peak value with the peak value in the cloud system and provides a research report. (See FIG. 6A).

Figure 6B:
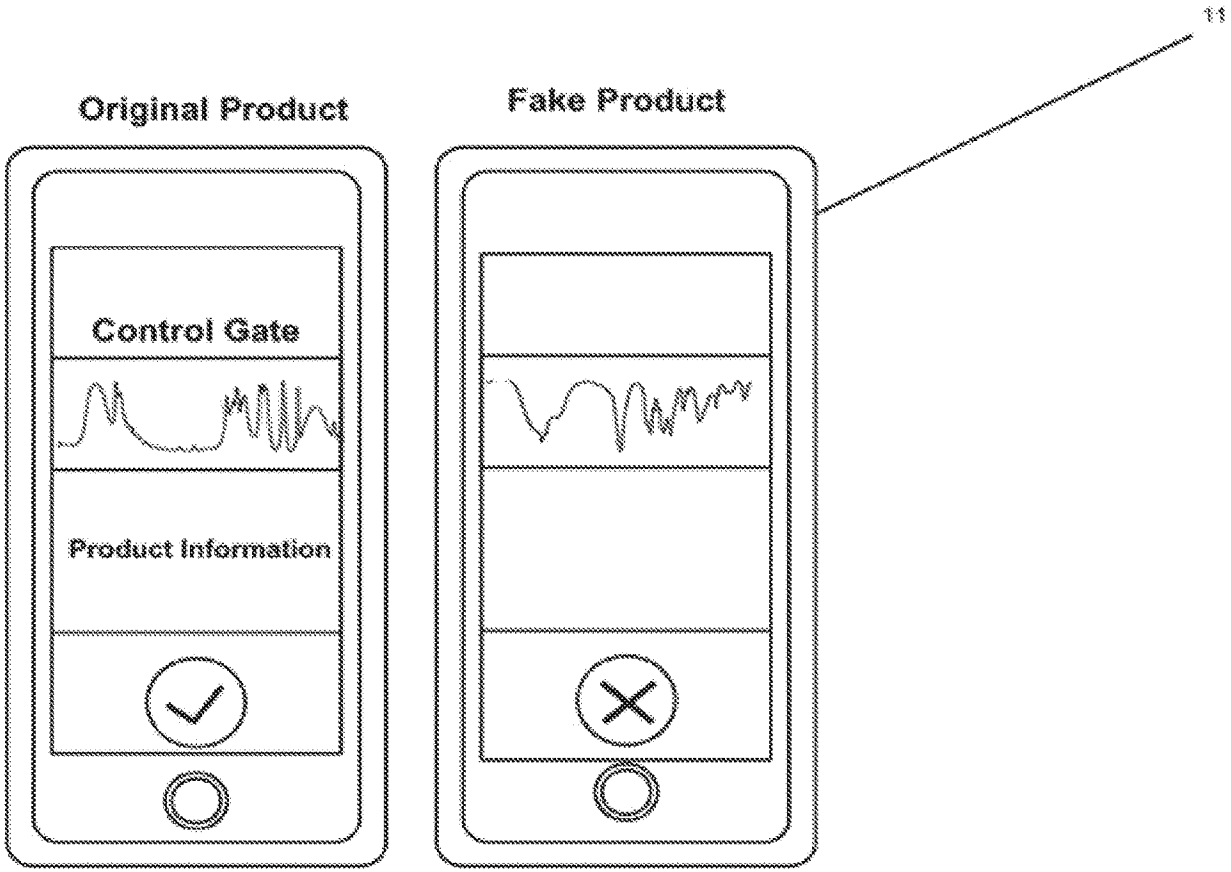

As shown in FIG. 6B, the end user selects the working area from the special printing material surface via the spectrometer application of the smartphone. The spectrometer sensor (11) embedded in the smartphone scans and analyzes the working area on the special printing material surface to be printed with high security and matches exactly the spectrum characteristic peak value with the peak value on the cloud system and displays the name of the scanned working area and the spectrum characteristic peak value on the screen of the smartphone.

The end user is enabled to buy an original product printed with high security using color-code combination inks on a special printing material surface. Whenever the high security working areas on the special printing material surface included on the original product is scanned with the spectrometer sensor (11) embedded in the smartphone, it is recorded by the tracking system.

For the high security printing implemented on the working areas on the special printing material surfaces using color-code combination inks to give perfect spectrum characteristic peak values, the inks will undergo various processes. Properties of color-code combination inks in the color system such as light intensity, brightness, chemical structure, viscosity, surface drying will be maintained in the required levels. Color-code combination inks will keep their homogeneous structure and freshness for a long time without any degradation.

The color-code combination ink components include pigments, binding agents, additives and carriers. By raising the pigment ratio of the color-code combination ink, its color and opaqueness can be increased. The binding agent binds the pigment to the special printing material surface giving brightness and chemical durability to the ink. The binding agent creates a good mixture with the pigment ensuring required level of pigment to be transferred to the special printing material surface and obtaining required level of drying sensitivity by absorbing the oxygen in the air. In accordance with the physical and chemical structures of the color-code combination inks, certain amounts of various additives are added. The additives maintain the present properties of the ink such as its shade and opaqueness while enabling the ink to be applied easily on the special printing material surface.

Color-code combination inks will be durable against friction and scratching thanks to its high color intensity and ink density. Additives in the color-code combination inks will increase their durability against physical and chemical effects. The special printing material surface printed with high security using color-code combination inks will be durable against friction and scratching as well as intense light and chemicals and maintain its properties.

The top layer of the special printing material receives the ink easily on its surface and helps it to be spread carrying it without causing any damage to the ink components. The bottom layer helps the special printing material surface to be saturated with the ink pigment and to remain on the top layer. When the special printing material surface is printed with color-code combination ink, the light intensity and brightness of the ink as well as its light and temperature durability will be strong.

The print head (7) will have the appropriate pore size to spray the pigmented color-code combination inks and the other agents to the special printing material surface. The sprayed color-code combination inks will be absorbed by the special printing material surface and dry quickly. When the printing is completed, the inks remaining on the print head (7) will be automatically cleaned with the chemical cleaning agent and dried.

The printer (1) will use an appropriate software for the high security printing processes. The printer (1) will connect to the computer in parallel and control codes as well as the data transfer will be sent from the computer to the printer (1). These control codes will help create synchronization between the computer and the printer (1). A continuous data exchange will be carried out between the computer and the printer (1). The auditing and controlling functions of the printer (1) will be performed by the microprocessor (2). There is a memory (3) which stores the information transferred to the printer (1). Based on the number of the color-code combinations inks to be used on the working areas to increase the printing security of the printer (1), the number of the ink tanks (5) can be increased, as well. Using the printing control and auditing menu on the computer screen or the printer (1) screen, the necessary adjustments can be made. The utilities and software, process interfaces, communication ports, sensors, power supplies and other components required in the hardware that support the operation of the printer (1) are present.

Color-code combination inks will be obtained for direct printing on industrial, textile, food and health products as well as the surfaces of material products with non-absorbent surfaces. With the print head (7) that can move with the desired printing angle in each direction and that can bend and grasp the product surface, high security printing using the color-code combination inks for direct printing on industrial, textile, food and health products as well as the surfaces of material products with non-absorbent surfaces will be possible.

Using the metallic color-code combination inks obtained by adding golden, silver and other gilded pigments in the inks, printing materials will be printed with high security. By ensuring the diffusion of the ink on the printing material surface, the physical or chemical drying processes appropriate for the ink brightness will be carried out. The drying agent will help the resin and pigment of the ink to be bound to the printing material in a short time causing it to get hardened and dried. By this way, the color intensity, brightness and chemical structures of the metallic color-code combination inks will become more complex.

High security working areas will be created and printed with information on valuable papers and documents such as banknotes, government bonds, stocks, private sector bonds, treasury bonds, investment funds and investment trust certificates, real estate certificates and lease certificates, profit and loss sharing certificates, eurobonds, policies, bills, and collateral in the usage areas of the printer (1).

High security working areas will be created and printed with information on valuable papers and documents such as identity cards, private ID cards, marriage certificates, driving licenses, passports and visa documents, brand/design/patent registry certificates, copyright documents, diplomas and certificates, notary documents, judicial and official documents, public and private corporation documents, books and magazines, official exam papers, ballots, title deeds, vehicle registry certificates, import-export documents and business enterprise documents.

Working areas on special printing material surface to be included in original products exposed for sale such as medicine, food, health and cosmetic products, industrial products, motor vehicle spare parts and accessories, white goods and small home appliances, electronic products, computers and mobile phones, antiques and art objects, cinema and music products, jewelry products, leather products, textile and furniture products, clothing and shoes will be printed with high security using color-code combination inks.

DESCRIPTION OF THE PROCESS STEPS

Figure 7C:
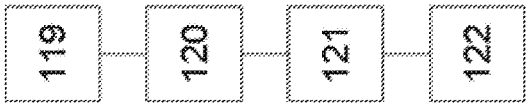
FIGS. 7A-7C illustrate flow charts of the process steps of the operation, printing security and control methods of the printer, in accordance with the present invention.
Figure 7B:
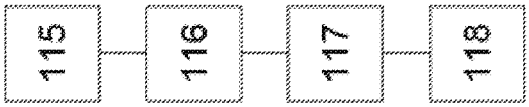
Figure 7A:
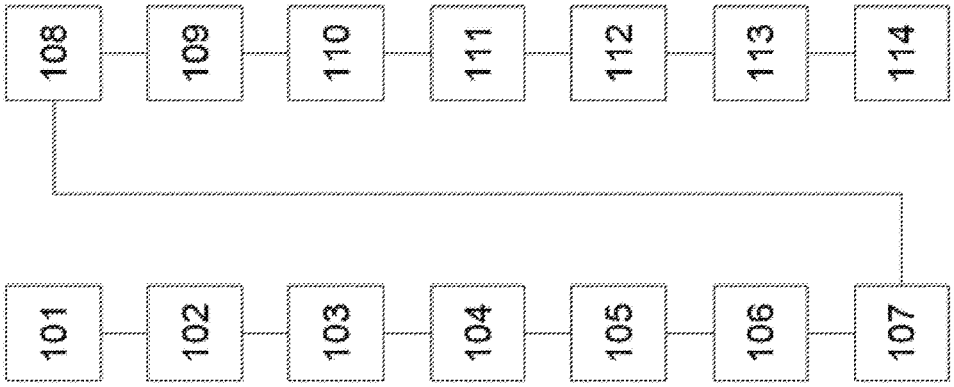

FIGS. 7A-7C illustrate exemplary embodiments of flow charts of the process steps of the operation, printing security and control methods of the printer.

As shown in FIG. 7A, an exemplary embodiment of the method of operation of the printer is described. At block 101, required amounts of the color-code combination inks produced in different combinations are taken and various color-code combination inks are obtained by mixing homogeneously. The steps for producing color-code combination inks are repeated with different combinations and thus thousands of unique color-code combination inks are obtained for the generation of a color system.

At block 102, in the manufacturing stage of the special printing material, different additives are added according to the material types. The special printing material type that is manufactured as well as the additive get coded together.

At block 103, the special printing material type to be used for the printing, the number and order of the high security working areas on the surface of the special printing material to be printed, the number of different inks to be used for each working area, the micron value of the printing thickness to be implemented and dimensions of each working area are obtained via a computer program and transferred to the printer (1) in a file format to be printed and stored in the memory (3).

At block 104, with the help of a predefined algorithm, the microprocessor (2) selects three different color-code combination inks for company/brand/product gate working areas that will be included on the special printing material surface to be printed as well as two different color-code combination inks for the control gate working area that will be included on the same special printing material surface.

At block 105, the three different color-code combination inks selected for the company/brand/product gate working areas that will be included on the special printing material surface as well as the two different color-code combination inks to be used for the control gate working area that will be included on the same special printing material surface are placed on the color unit (4) with the help of a predefined algorithm.

At block 106, each one of the five different color-code combination inks placed in the color unit (4) is put in the ink tank (5).

At block 107, the value of the ink volume to be consumed is determined via a predefined algorithm on the digital screen of the ink tank (5) in which each one of the three different color-code combination inks to be used in the company/brand/product gate working areas included on the special printing material surface is put.

At block 108, while the value of the ink volume to be consumed for the homogeneous ink mixture of each of the two different color-code combination inks for the control gate working area that will be included on the same special printing material surface decreases, the value of the ink volume of the other ink to be consumed for the ink mixture increases accordingly. In this way, the ratios of the two different color-code combination inks to be used for the control gate working area that will be included on the same special printing material surface in the homogeneous ink mixture continuously change for each of the special printing material surface.

At block 109, the changing value of the ink volume to be consumed for the homogeneous ink mixture on the digital screen of the ink tank (5) in which each one of the two different color-code combination inks to be used on the control gate working area included on the same special printing material surface is put is calculated via a predefined algorithm.

At block 110, the value of the ink volume to be consumed is displayed on the digital screen of the ink tank (5) in which each one of the three different color-code combination inks to be used in the company/brand/product gate working areas included on the special printing material surface is put and the ink is consumed and sent to the print head (7) via the ink transmitter (6).

At block 111, after the changing value of the ink volume to be consumed for the homogeneous ink mixture is displayed on the digital screen of the ink tank (5) in which each one of the two different color-code combination inks to be used in the control gate working area included on the same special printing material surface is put, the ink is consumed and first mixed in the ink transmitter (6). Thereafter, the homogeneous ink mixture obtained by the short-term vibrations of the ink transmitter (6) is sent to the print head (7).

At block 112, the electronic material sensor (8) placed in the material feeding area identifies the type of the special printing material to be used for printing as well as the additives and transmits the code to the microprocessor (2). The microprocessor (2) notifies the user that the printer (1) is ready for the printing process following the approval of the code of the additive and the special printing material type to be used for printing.

At block 113, the ink heater (9) in the print head (7) heats the inks received by the print head (7) to a particular temperature according to the electrical signals from the control unit. With the help of the engine that triggers the print head (7) without contacting the printing material, the heated inks are sprayed with a pressure from the active pores in the print head (7) directly to the working areas on the special printing material surface for the printing of the specified micron value.

At block 114, the printer (1) ensures high security printing using color-code combination inks on company/brand/product/control gate working areas on the special printing material surface.

As shown in FIG. 7B, an exemplary embodiment of the method of the printing security of the printer is described. At block 115, the spectrum characteristic peak values of the company/brand/product gate working areas on the special printing material to be printed are different from each other. However, these working areas to be included on each special printing material surface that is printed always give the same characteristic peak values.

At block 116, the spectrum characteristic peak value of the control gate working area on the same special printing material surface that is printed is always different on each special printing material surface. This is because the ratios of the inks of the homogenous ink mixtures used on the control gate working area continuously change for each special printing material surface.

At block 117, the spectrum characteristic peak values of the working areas on each special printing material surface that is printed with high security are coded with a predefined algorithm, archived in the main server, backed up and stored. The spectrum characteristic peak values of the working areas on each special printing material surface that is printed with high security are loaded on the cloud system.

At block 118, each special printing material that is printed with high security is used on a different original product exposed for sale.

As shown in FIG. 7C, an exemplary embodiment of the control method for the printer is described. At block 119, the customized handheld spectrometer sensor (10) scans and analyzes the working areas on the special printing material surface that is printed with high security, then displays the name of the scanned working area and the spectrum characteristic peak values of each working area on the screen. The customized handheld spectrometer sensor (10) scans and analyzes the working area on the special printing material surface that is printed with high security, then matches exactly the spectrum characteristic peak value with the peak value in the cloud system and provides a research report.

At block 120, the end user selects the working area from the special printing material surface via the spectrometer application of the smartphone. The spectrometer sensor (11) embedded in the smartphone scans and analyzes the working area on the special printing material surface to be printed with high security and matches exactly the spectrum characteristic peak value with the peak value on the cloud system and displays the name of the scanned working area and the spectrum characteristic peak value on the screen of the smartphone.

At block 121, the end user is enabled to buy an original product printed with high security using color-code combination inks on a special printing material surface.

At block 122, whenever the high security working areas on the special printing material surface included on the original product is scanned with the spectrometer sensor (11) embedded in the smartphone, it is recorded by the tracking system.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A method of operating a printer for implementing high security printing on company/brand/product/control gate working areas on a special printing material surface using color-code combination inks, the printer comprising:

a microprocessor enabling a control and audit of the printer; a memory where information about the working areas on the special printing material surface to be printed is stored; a color unit where different color-code combination inks are selected and placed via a first predefined algorithm; an ink tank with a digital screen that calculates an ink volume of at least one of the color-code combination inks to be consumed during printing through a second predefined algorithm on its digital screen; ink transmitters that transfer consumed color-code combination inks from the ink tank to the spray nozzles; a print head that implements the printing on the working areas on the special printing material surface; an electronic material sensor that identifies a type of the special printing material as well as additives used and transmits a code to the microprocessor; an ink heater in the print head that heats the color-code combination inks to a particular temperature based on electrical signals sent from a control unit, the method comprising:

selecting required amounts of the color-code combination inks produced in different combinations and obtaining various color-code combination inks by mixing homogeneously, repeating steps for producing color-code combination inks with different combinations and obtaining thousands of unique color-code combination inks for the generation of a color system (101);

adding different additives according to material types in a manufacturing stage of the special printing material, and coding together a special printing material type that is manufactured with the additive (102);

obtaining via a computer program, data including the special printing material type to be used for the printing, a number and order of the high security working areas on the surface of the special printing material to be printed, a number of different inks to be used for each working area, a micron value of a printing thickness to be implemented and dimensions of each working area, and transferring the data to the printer in a file format to be printed and stored in the memory (103);

the microprocessor (2), via the first predefined algorithm, selecting three different color-code combination inks for company/brand/product gate working areas that will be included on the special printing material surface to be printed as well as two different color-code combination inks for the control gate working area that will be included on the same special printing material surface (104);

placing, via the first predefined algorithm, the three different color-code combination inks selected and the two different color-code combination inks selected on the color unit (4) (105);

depositing each one of the five different color-code combination inks placed in the color unit (4) in the ink tank (5) (106);

calculating, via the second predefined algorithm, a value of the ink volume to be consumed on the digital screen of the ink tank (5) in which each one of the three different color-code combination inks to be used is put (107);

while the value of the ink volume to be consumed for a homogeneous ink mixture of each of the two different color-code combination inks for the control gate working area that will be included on the same special printing material surface decreases, the value of the ink volume of the other ink to be consumed for the ink mixture increases accordingly, such that the ratios of the two different color-code combination inks to be used for the control gate working area that will be included on the same special printing material surface in the homogeneous ink mixture continuously change for each special printing material surface (108);

calculating via a third predefined algorithm, a changing value of the ink volume to be consumed for the homogeneous ink mixture on the digital screen of the ink tank (5) in which each one of the two different color-code combination inks is put (109);

displaying the value of the ink volume to be consumed on the digital screen of the ink tank (5) in which each one of the three different color-code combination inks is put (110);

after displaying the changing value of the ink volume to be consumed for the homogeneous ink mixture on the digital screen of the ink tank (5), first mixing the ink in the ink transmitter (6), consuming the ink, and thereafter sending the homogeneous ink mixture obtained by short-term vibrations of the ink transmitter (6) to the print head (7) via the ink transmitter (111);

identifying via the electronic material sensor (8) placed in the material feeding area, the type of the special printing material to be used for printing as well as the additives, and transmitting the code to the microprocessor (2); the microprocessor notifying the user that the printer (1) is ready for the printing process following an approval of the code of the additive and the special printing material type to be used for printing (112);

heating with the ink heater the inks received by the print head (7) to a particular temperature according to the electrical signals from the control unit; and spraying the heated inks with a pressure from the active pores in the print head (7) directly to the working areas on the special printing material surface for the printing of the specified micron value (113), with an engine that triggers the print head (7) without contacting the printing material;

wherein the printer enabling high security printing using color-code combination inks on company/brand/product/control gate working areas on the special printing material surface (114).

2. The method of claim 1, wherein spectrum characteristic peak values of the company/brand/product gate working areas on the special printing material to be printed are different from each other; and working areas to be included on each special printing material surface that is printed always give the same characteristic peak values (115).

3. The method of claim 1, wherein a spectrum characteristic peak value of the control gate working area on the same special printing material surface that is printed is always different on each special printing material surface, such that the ratios of the inks of the homogenous ink mixtures used on the control gate working area continuously change for each special printing material surface (116).

4. The method of claim 2, wherein the spectrum characteristic peak values of the working areas on each special printing material surface that is printed with high security are coded with a fourth predefined algorithm, archived in the main server, backed up and stored.

5. The method of claim 3, wherein the spectrum characteristic peak values of the working areas on each special printing material surface that is printed with high security are coded with a fourth predefined algorithm, archived in the main server, backed up and stored.

6. The method of claim 2, wherein the spectrum characteristic peak values of the working areas on each special printing material surface that is printed with high security are loaded on a cloud system (117).

7. The method of claim 2, wherein each special printing material that is printed with high security is used on a different original product exposed for sale (118).

8. A method for controlling the company/brand/product/control gate working areas of the printer operated by the method of claim 1, that prints with high security on special printing material surface of an original product by an end user, comprising:

scanning and analyzing the working areas on the special printing material surface that is printed with high security via a customized handheld spectrometer sensor (10), displaying a name of the scanned working area and a spectrum characteristic peak value of each working area on the screen, matching exactly the spectrum characteristic peak value with a peak value in the cloud system and providing a research report (119), the end user selecting the working area from the special printing material surface via a spectrometer application of a smartphone;

scanning and analyzing the working area on the special printing material surface to be printed with high security via a spectrometer sensor (11) embedded in the smartphone, matching exactly the spectrum characteristic peak value with the peak value on the cloud system, displaying simultaneously the name of the scanned working area and the spectrum characteristic peak value on a screen of the smartphone (120), enabling the end user to buy an original product printed with high security using color-code combination inks on a special printing material surface (121), and recording by a tracking system whenever the high security working areas on the special printing material surface included on the original product is scanned with the spectrometer sensor (122).

9. The method of claim 8, wherein spectrum characteristic peak values of the company/brand/product gate working areas on the special printing material to be printed are different from each other; and working areas to be included on each special printing material surface that is printed always give the same characteristic peak values (115).

10. The method of claim 8, wherein a spectrum characteristic peak value of the control gate working area on the same special printing material surface that is printed is always different on each special printing material surface, such that the ratios of the inks of the homogenous ink mixtures used on the control gate working area continuously change for each special printing material surface (116).

11. A printer for implementing high security printing on company/brand/product/control gate working areas on a special printing material surface using color-code combination inks, comprising:

a microprocessor enabling a control and audit of the printer;

a memory where information about the working areas on the special printing material surface to be printed is stored;

a color unit where different color-code combination inks are selected and placed via a first predefined algorithm;

an ink tank with a digital screen that calculates an ink volume of at least one of the color-code combination inks to be consumed during printing through a second predefined algorithm on its digital screen;

ink transmitters that transfer consumed color-code combination inks from the ink tank to the spray nozzles;

a print head that implements the printing on the working areas on the special printing material surface;

an electronic material sensor that identifies a type of the special printing material as well as additives used and transmits a code to the microprocessor;

an ink heater in the print head that heats the color-code combination inks to a particular temperature based on electrical signals sent from a control unit.

12. The printer of claim 11, further comprising a computer program configured to obtain data including the special printing material type to be used for the printing, a number and order of the high security working areas on the surface of the special printing material to be printed, a number of different inks to be used for each working area, a micron value of a printing thickness to be implemented and dimensions of each working area, and transfer the data to the printer in a file format to be printed and stored in the memory.

13. The printer of claim 12, wherein the microprocessor (2), via the first predefined algorithm, selects three different color-code combination inks for company/brand/product gate working areas that will be included on the special printing material surface to be printed as well as two different color-code combination inks for the control gate working area that will be included on the same special printing material surface;

the first predefined algorithm places the three different color-code combination inks selected and the two different color-code combination inks selected on the color unit (4);

the printer configured to deposit each one of the five different color-code combination inks placed in the color unit (4) in the ink tank (5);

the second predefined algorithm, calculates a value of the ink volume to be consumed on the digital screen of the ink tank (5) in which each one of the three different color-code combination inks to be used is put; and while the value of the ink volume to be consumed for a homogeneous ink mixture of each of the two different color-code combination inks for the control gate working area that will be included on the same special printing material surface decreases, the value of the ink volume of the other ink to be consumed for the ink mixture increases accordingly, such that the ratios of the two different color-code combination inks to be used for the control gate working area that will be included on the same special printing material surface in the homogeneous ink mixture continuously change for each special printing material surface.

14. The printer of claim 13, further comprising a third predefined algorithm, for calculating a changing value of the ink volume to be consumed for the homogeneous ink mixture on the digital screen of the ink tank (5) in which each one of the two different color-code combination inks is put;

the digital screen displays the value of the ink volume to be consumed on the digital screen of the ink tank (5) in which each one of the three different color-code combination inks is put (110).

15. The printer of claim 11, wherein spectrum characteristic peak values of the company/brand/product gate working areas on the special printing material to be printed are different from each other; and working areas to be included on each special printing material surface that is printed always give the same characteristic peak values.

16. The printer of claim 11, wherein a spectrum characteristic peak value of the control gate working area on the same special printing material surface that is printed is always different on each special printing material surface, such that the ratios of the inks of the homogenous ink mixtures used on the control gate working area continuously change for each special printing material surface.

17. The printer of claim 15, further comprising a fourth predefined algorithm for coding the spectrum characteristic peak values of the working areas on each special printing material surface that is printed with high security and which are archived in the main server, backed up and stored.

18. The printer of claim 16, further comprising a fourth predefined algorithm for coding the spectrum characteristic peak values of the working areas on each special printing material surface that is printed with high security are coded and which are archived in the main server, backed up and stored.

19. The printer of claim 15, wherein the spectrum characteristic peak values of the working areas on each special printing material surface that is printed with high security are loaded on a cloud system.

20. The printer of claim 15, wherein each special printing material that is printed with high security is used on a different original product exposed for sale.

* * * * *